US007338686B2

(12) United States Patent
Kiyokawa et al.

(10) Patent No.: US 7,338,686 B2
(45) Date of Patent: Mar. 4, 2008

(54) METHOD FOR PRODUCING CONDUCTIVE PARTICLES

(75) Inventors: Hajime Kiyokawa, Fukui (JP); Kiyoto Fukuoka, Fukui (JP)

(73) Assignee: Kiyokawa Plating Industry Co., Ltd., Fukui (JP)

( * ) Notice: Subject to any disclaimer, the term of this patent is extended or adjusted under 35 U.S.C. 154(b) by 127 days.

(21) Appl. No.: 10/822,695

(22) Filed: Apr. 13, 2004

(65) Prior Publication Data

US 2004/0208992 A1 Oct. 21, 2004

(30) Foreign Application Priority Data

Apr. 18, 2003 (JP) ..... 2003-114959

(51) Int. Cl.
*C23C 18/34* (2006.01)
*C23C 18/40* (2006.01)
*B05D 7/00* (2006.01)

(52) U.S. Cl. ..... 427/216; 427/215; 427/217; 427/222; 427/437; 427/438; 427/443.1

(58) Field of Classification Search ..... None
See application file for complete search history.

(56) References Cited

U.S. PATENT DOCUMENTS 3,754,939 A * 8/1973 Pearlstein et al. ..... 106/1.24
3,926,570 A * 12/1975 Wilks ..... 428/570
5,453,293 A * 9/1995 Beane et al. ..... 427/96.1
5,525,570 A * 6/1996 Chakraborty et al. ..... 502/326
5,624,479 A * 4/1997 Boecker et al. ..... 106/1.11

FOREIGN PATENT DOCUMENTS

JP 63020487 A * 1/1988
JP P2000-294236 10/2000

* cited by examiner

*Primary Examiner*—Katherine Bareford
(74) *Attorney, Agent, or Firm*—McDermott Will & Emery LLP

(57) ABSTRACT

The present invention provides a low-cost method for producing conductive particles in a short period of time by simplifying pretreatment in electroless plating. The method for producing conductive particles includes the steps of: introducing a solution composed mainly of palladium chloride and hydrochloric acid into an electroless plating bath containing particles of an organic material or an inorganic material while stirring the bath; and simultaneously applying an electroless plating to the surface of the particles and allowing the palladium catalyst to be carried on the surface of the particles to give conductive particles having an electroless plate coating.

4 Claims, 1 Drawing Sheet

METHOD FOR PRODUCING CONDUCTIVE PARTICLES

BACKGROUND OF THE INVENTION

The present invention relates to a method for producing conductive particles.

Techniques for forming a conductive coating on a particle are drawing attention in various fields such as anisotropic conductive particles used for bonding a semiconductor chip or a liquid crystal panel, conductive paint for shielding electromagnetic wave, and electrode materials for secondary batteries of a great power.

In the case where a nonconductive material or a low conductive material is subjected to electroless plating, pretreatment process including immersion degreasing, surface conditioning, etching and catalyzing is usually required before electroless plating.

Commonly used catalyzing methods are a method in which a sensitizing step using stannous chloride and hydrochloric acid and an activation step using palladium chloride and hydrochloric acid are repeatedly (several times) performed with a water rinse between the sensitizing and activation steps, and a method in which a catalyzing step using a colloidal material made of tin and palladium and an activating step using hydrochloric acid or sulfuric acid to remove tin are repeatedly (several times) performed with a water rinse between the catalyzing and activation steps. These methods are disclosed, for example, in Japanese Patent Laid-Open No. 2000 -294236.

Both these methods are based on a mechanism in which a catalyst is activated by reducing palladium ions into metallic palladium in the presence of divalent tin ions with reducing power. The catalyzing step as described above may sometimes be used in the case of forming a metal plate coating with a lower potential on a metal with a higher potential such as the case where the surface of copper is plated with nickel.

Conductive particles can be produced by the electroless plating as described above, but the conventional methods are complicated because of the pretreatment process. Moreover, in order to prevent particles from carrying a solution obtained at one step into the next step, the conventional methods require, for example, repeated operations of rinsing and filtration, which requires a large amount of time.

Particles used for producing conductive particles have a very large specific surface area of about 0.2 to 0.5 $m^2/g$. For example, 100 g of particles have a total surface area of 5000 $DCM^2$ at the maximum, which is much larger than the area that is normally plated. Because of this, in the conventional catalyzing step, the amount of palladium to be adsorbed becomes insufficient, which makes it difficult to form an electroless plate coating. In addition to this, the use of a large amount of treatment solution in consideration of the bath ratio creates a great cost burden because costly catalyzer is spent in only one step.

In view of the above, it is an object of the present invention to provide a low-cost method for producing conductive particles in a short period of time by simplifying pretreatment process in the electroless plating.

BRIEF SUMMARY OF THE INVENTION

The present invention relates to a method for producing conductive particles comprising the steps of:

introducing a solution composed mainly of palladium chloride and hydrochloric acid into an electroless plating bath containing particles of an organic material or an inorganic material while stirring said bath; and simultaneously applying an electroless plating to the surface of the particles and allowing the palladium catalyst to be carried on the surface of the particles to give conductive particles having an electroless plate coating.

The solution preferably has a palladium chloride concentration of 0.3 to 10 g/L.

Further, the electroless plate coating preferably has three-dimensionally connected pores that allow water molecules, hydroxy ions, sodium ions or potassium ions to pass through and diffuse.

The pores may be present only inside the electroless plate coating. Alternatively, the surface of the particles may partly be exposed to the outside due to the presence of the pores.

The inorganic material preferably comprises at least one selected from the group consisting of Cu, Ni, Al, Fe, Ag, Mo and W or any alloy thereof. It is also preferred that the inorganic material comprises at least one selected from the group consisting of $Al_2O_3$, $SiO_2$, $Ni(OH)_2$ and $Ca(OH)_2$.

Furthermore, the electroless plate coating preferably comprises at least one selected from the group consisting of Ni, Ni—P, Ni—B, Cu, an Ni-PTFE composite coating and a Cu-PTFE composite coating.

While the novel features of the invention are set forth particularly in the appended claims, the invention, both as to organization and content, will be better understood and appreciated, along with other objects and features thereof, from the following detailed description taken in conjunction with the drawings.

DETAILED DESCRIPTION OF THE INVENTION

Figure 1:
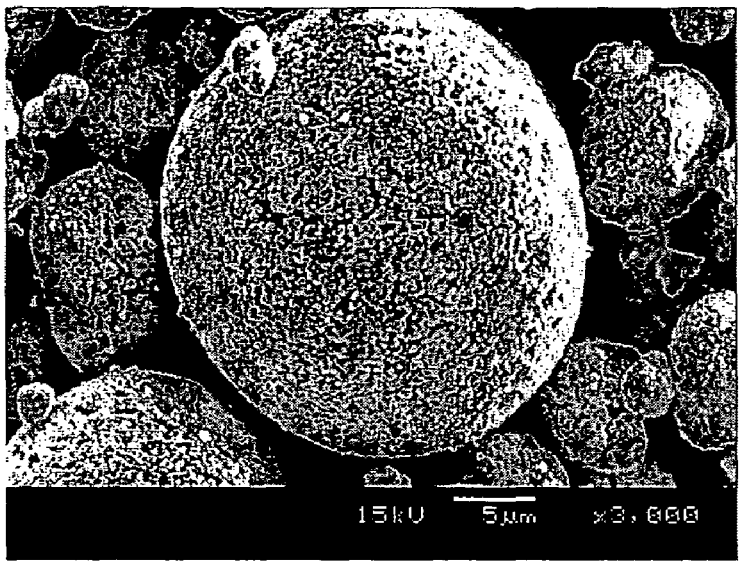
FIG. 1 is an electron microscope image of the conductive particles produced in EXAMPLE of the present invention.

In the method for producing conductive particles in accordance with the present invention, a solution composed mainly of palladium chloride and hydrochloric acid is introduced into an electroless plating bath containing particles of an organic or inorganic material to simultaneously apply an electroless plating onto the surface of the particles and allow the palladium catalyst to be carried on the surface of the particles to give conductive particles having an electroless plate coating on the surface thereof.

In the electroless plating step, the solution composed mainly of palladium chloride is introduced into the stirred plating bath, together with a surfactant for allowing the particles to be monodisperse. This facilitates the dispersion of palladium ions and, almost at the same time, allows the palladium ions to be adsorbed onto the surface of the particles because the particles have a large specific surface area.

The feature of the method for producing conductive particles of the present invention lies in avoiding the use of divalent tin ions. In other words, the present invention does not require the use of tin ions. This is because the palladium ions dispersed and adsorbed immediately after the introduction of palladium chloride are reduced by a reducing agent contained in the electroless plating bath. It is therefore possible to eliminate the repeated process of sensitizing and activation in the present invention.

The particles to be used for producing conductive particles of the present invention are made of an organic or inorganic material. The mean particle size of the particles is not specifically limited as long as the electroless plating process is not hampered. In particular, there is no specific upper limit on the particle size because the greater the particle size is, the more easily the particles are plated. The lower limit, on the other hand, is preferably several ,μm to several ten gin, specifically 5 to 20μm.

Examples of the organic material include, polytetrafluoroethylene, polyethylene, polypropylene, ABS resin, polyamide, polysulfone, AS resin, polystyrene, vinylidene chloride resin, polyphenylene ether, methyl-pentene resin, methacrylic acid resin and benzoguanamine resin.

Examples of the inorganic material include carbon, graphite, Cu, Ni, Al, Fe, Ag, Mo and W. They may be used singly or in any combination thereof Additional examples include oxides and hydroxides such as $Al_2O_3$, $SiO_2$, $Ni(OH)_2$ and $Ca(OH)_2$. They may also be used singly or in any combination thereof.

The electroless plating bath used in the present invention is now described below.

The supply source of the metal ions may be, for example, a metal salt of sulfuric acid or sulfamic acid, or chloride of a metal. The concentration of the metal ions is preferably 5 to 20 g/L.

The complexing agent may be any compound having complexing ability to metal ions such as glycin, ethylenediamine, ammonium, EDTA, citric acid, tartaric acid, malic acid, lactic acid, gluconic acid or a metal salt. The concentration thereof is preferably 5 to 50 g/L.

The reducing agent may be, for example, sodium hypophosphite, sodium borohydride, potassium borohydride, dimethylaminboran or hydrazine. The concentration thereof is preferably 5 to 100 g/L. The pH of the electroless plating bath depends on the type of reducing agent used. For example, in the case of the reducing agent being sodium hypophoshpite, the pH is preferably 6 to 10. In the case of sodium borohydride, the ph is preferably 7 to 13. In the case of hydrazine, the ph is preferably 9 to 12.

In the present invention, a solution composed mainly of palladium chloride and hydrochloric acid is introduced into the electroless plating bath containing the particles of the organic or inorganic material described above while stirring the bath.

The stirring is preferably performed at a rate of 100 to 700 rpm for 20 to 180 minutes. The temperature of the plating bath ranges from room temperature to 90° C., depending on the type of plating bath used. Those skilled in the art may properly adjust the temperature.

The solution composed mainly of palladium chloride and hydrochloric acid to be introduced is described here.

The only requirement for this solution is to include palladium chloride and hydrochloric acid. The concentration and composition may be properly adjusted by those skilled in the art such that the concentration of palladium chloride in the electroless plating bath will not be too low when the solution is introduced into the electroless plating bath. The concentration of palladium chloride in the solution is preferably 0.3 to 10 g/L, more preferably 0.3 to 5 g/L because the maximum concentration thereof equals 10 times or more of the concentration of a solution used in an ordinary activation step.

Since the stirring for allowing the particles to be monodisperse is performed in the present invention, even when a small amount of the solution with a high concentration is used, palladium ions can be dispersed and adsorbed. Accordingly, the amount of the solution to be introduced can be greatly reduced compared to the amount normally used in an ordinary activation step, which proves that the method for producing conductive particles of the present invention is low cost.

Such operations as described above allow the catalyst to be carried on the surface of the particles and, at the same time, applies the electroless plating onto the surface of the particles to give conductive particles having an electroless plate coating.

According to the production method of the present invention as described above, the electroless plate coating will have three-dimensionally connected pores that allow water molecules, hydroxy ions, sodium ions or potassium ions to pass through and diffuse.

Because of the presence of the pores, it can be said that the electroless plate coating is discontinuous. The pores may be present only inside the electroless plate coating. Alternatively, the surface of the particles may partly be exposed to the outside due to the presence of the pores.

As described above, the introduction of the solution composed mainly of palladium chloride and hydrochloric acid instantly enables the dispersion of palladium to allow it to be adsorbed onto the surface of the particles. The palladium is not always adsorbed uniformly onto the surface of the particles. This slightly reduces the number of active sites as nucleuses compared to a conventional method, degrading the continuity of the coating to be formed. By virtue of this discontinuity, the resultant coating will be porous, making it possible for water molecules, hydroxy ions, sodium ions or potassium ions to pass through and diffuse.

The electroless plate coating comprises at least one selected from the group consisting of Ni, Ni—P, Ni—B, Cu, an Ni-PTFE composite coating and a Cu-PTFE composite coating.

In the following, the present invention is described in detail using EXAMPLE. However, it is to be noted that the present invention is not limited to this example shown here.

EXAMPLE

In this example, spherical copper powders with a mean particle size of 10μm as inorganic material particles were plated with nickel. An electroless plating bath used here had the following composition.

| | |
|---|---|
| Nickel sulfate | 22.0 g/L |
| Glycin | 33.3 g/L |
| Sodium hypophosphite | 23.3 g/L |
| Sodium hydroxide | 12.3 g/L |
| Surfactant | 10 mL/L |
| pH | 9.5 |

Three liters of the plating bath having the above composition was prepared at 60° C., and 50 g of the copper powders was directly introduced into the plating bath. In other words, pretreatment process such as immersion degreasing, surface conditioning and etching was not performed at all. After the copper powders were introduced, propeller stirring was performed at a rate of 500 revolutions per minute for 10 minutes. Then, 20 mL of a solution composed mainly of palladium chloride and hydrochloric acid (i.e. activator, palladium chloride concentration of 2 g/L) was added thereto.

Immediately after the addition of this solution, bubbling started and the reduction of palladium ions and nickel plating started to proceed. The propeller stirring was continuously performed at a rate of 500 revolutions per minute for 30 minutes until the bubbling stopped. After the bubbling stopped, the stirring was halted. A filtration using a suction filter and a water rinse (washing with water) were repeated three times, and then the resultant was dried with warm air at 80° C. for 1 hour. Thereby, conductive particles of the present invention were produced.

[Evaluation]

FIG. 1 shows an electron microscope image of the obtained conductive particles. As obvious from FIG. 1, a discontinuous nickel plate coating was formed on the surface of the copper powder particles as inorganic material particles. This discontinuous plate coating allows water molecules, hydroxy ions, sodium ions or potassium ions to pass through and diffuse.

COMPARATIVE EXAMPLE

For comparison, 50 g of copper powders from the same lot as that used in EXAMPLE, was immersed in 300 mL of a sensitizer containing 30 g/L of stannous chloride and 15 m/L of hydrochloric acid at 25° C. for 3 minutes, which was then water-rinsed and filtered. The obtained copper powders were immersed in 1.5 L of an activator containing 0.2 g/L of palladium chloride and 4 ml/L of hydrochloric acid at 25° C. for 3 minutes, which was then water-rinsed and filtered. These steps were repeated twice.

The activator was first dark brown colored, and after the above treatment, it became light brown colored. At the same time, the concentration of palladium chloride was reduced from 0.30 g/L to 0.13 g/L, which indicated a large amount of palladium ions were consumed. In the conventional catalyzing process, the change in the concentration of palladium ions is minute, the activator can therefore be repeatedly used. The concentration of the activator in this comparative example, however, exceeded the tolerance for repeated use so that the activator had to be discarded.

The copper powders having been subjected to the pretreatment process such as the sensitizing and activation steps were introduced into the plating bath having the composition shown in EXAMPLE while stirring at a rate of 500 revolutions per minute. Although no bubbling was observed even after 30 minutes of stirring, the stirring was stopped and the resultant was filtered, water-rinsed and dried in the same manner as in EXAMPLE to give conductive particles for comparison.

[Evaluation]

Figure 2:
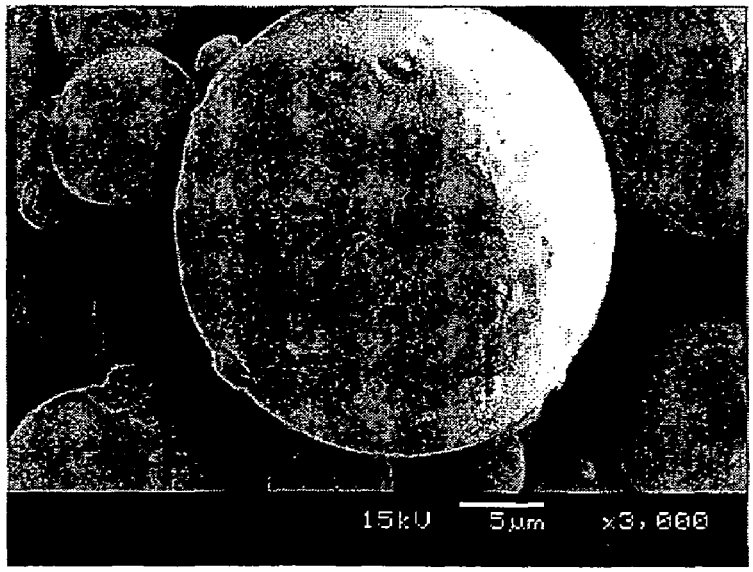
FIG. 2 is an electron microscope image of the conductive particles produced in COMPARATIVE EXAMPLE of the present invention.

FIG. 2 shows an electron microscope image of the conductive particles for comparison obtained above. As obvious from FIG. 2, a plate coating was not formed on the surface of the conductive particles for comparison. This fact was also confirmed by the result of ICP analysis.

As described above, according to the method of the present invention in which the particles of an organic or inorganic material are introduced in a stirred electroless plating bath to allow the catalyzing process and electroless plating process to proceed simultaneously so as to give conductive particles, it is possible to produce conductive particles in a short period of time at low cost.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

The invention claimed is:

1. A method for producing conductive particles comprising the steps of:

introducing a solution composed mainly of palladium chloride and hydrochloric acid into an electroless plating bath containing a reducing agent, and one from the group consisting of particles of an organic material or particles of an inorganic material while stirring said bath; and simultaneously applying an electroless plating to the surface of said particles and allowing the palladium catalyst to be carried on the surface of said particles to give conductive particles having an electroless plate coating, wherein said electroless plate coating comprises at least one selected from the group consisting of Ni, Ni-P, Ni-B, Cu, an Ni-PTFE composite coating and a Cu-PTFE composite coating, and wherein said electroless plate coating has three-dimensionally connected pores that allow water molecules, hydroxy ions, sodium ions or potassium ions to pass through and diffuse.

2. The method for producing conductive particles in accordance with claim 1, wherein said solution has a palladium chloride concentration of 0.3 to 10 g/L.

3. The method for producing conductive particles in accordance with claim 1, wherein said inorganic material comprises at least one selected from the group consisting of Cu, Ni, Al, Fe, Ag, Mo and W or any alloy thereof.

4. The method for producing conductive particles in accordance with claim 1, wherein said inorganic material comprises at least one selected from the group consisting of $Al_2O_3$, $SiO_2$, $Ni(OH)_2$ and $Ca(OH)_2$.

* * * * *